United States Patent [19]

Kuzuno et al.

[11] Patent Number: 5,000,698

[45] Date of Patent: Mar. 19, 1991

[54] TERMINAL CONNECTOR

[75] Inventors: Katsutoshi Kuzuno; Shigeo Ishizuka; Masayuki Yamamoto, all of Shizuoka, Japan

[73] Assignee: Yazaki Corporation, Japan

[21] Appl. No.: 419,664

[22] Filed: Oct. 11, 1989

[30] Foreign Application Priority Data

Oct. 12, 1988 [JP] Japan ..... 63-132355[U]

[51] Int. Cl.[5] ..... H01R 4/24

[52] U.S. Cl. ..... 439/395

[58] Field of Search ..... 439/389–426

[56] References Cited

U.S. PATENT DOCUMENTS

| | | | |
|---|---|---|---|
| 1,672,201 | 6/1928 | Champion | 439/424 |
| 2,630,468 | 3/1953 | Felts et al. | 439/421 |
| 3,914,004 | 10/1975 | Bone | 439/421 |
| 4,261,632 | 4/1981 | Narozny | 439/421 |
| 4,740,171 | 4/1988 | Holden et al. . | |

FOREIGN PATENT DOCUMENTS 6091573 4/1985 Japan .

*Primary Examiner*—Joseph H. McGlynn
*Attorney, Agent, or Firm*—Wigman & Cohen

[57] ABSTRACT

Disclosed herein is a terminal connector to which an electrical wire having a conductor and an insulating cover surrounding the conductor, which comprises an electrical connecting section to which a partner member is electrically connected, an electrical wire connecting section to which the electrical wire is to be connected, and a connecting member adapted to be mounted to the wire connecting section for electrically connecting the conductor of the electrical wire to the wire connecting section during mounting the connecting member to the terminal connector. The connecting member is formed from a U-shaped plate-like conductive member having a recess in which the electrical wire is securedly connected. The U-shaped connecting member includes two leg portions each having a tip portion, and each of the tip portions of the leg portions of the connecting member has an inclined edge for cutting or stripping the insulating cover when the connecting member is mounted to the wire connecting section.

10 Claims, 3 Drawing Sheets

TERMINAL CONNECTOR

BACKGROUND OF THE INVENTION

1. Field of the Invention

This invention relates to a terminal connector, and in particular to a terminal connector to which an electrical wire with an insulating cover can be electrically connected without stripping the insulating cover in advance of the connecting operation of the wire.

2. Description of the Prior Art

Conventionally, as such a terminal connector, there is known a terminal connector as disclosed in Japanese Laid-open Patent Publication No. 60-91573.

The conventional connector has a terminal body comprising an electrical connecting section to which a partner terminal connector is electrically connected and a wire connecting section to which a connecting member is electrically mounted.

The connecting member comprises a C-shaped member having a base plate portion and first and second erected wall portions provided on opposite sides of the base plate portion. The first erected wall portion has a recess into which an insulating cover of an electrical wire is tightly secured. The second erected wall portion also has a recess, of which width is narrower than that of the recess of the former wall portion, into which a conductor of the electrical wire is tightly secured to establish an electrical connection between the connecting member and the conductor.

In use of the terminal connector, first the connecting member is mounted to the wire connecting section of the terminal body by clamping clamping portions provided opposite sides of the wire connecting section with the base plate portion of the connecting member. Then, the electrical wire is attached to the connecting member by pressurizingly inserting the electrical wire into the recesses of the first and second wall portions of the connecting member. In this case, the insulating cover of the electrical cover is tightly secured within the recess of the first wall portion of the connecting member. On the other hand, since the width of the recess of the second wall portion is smaller than that of the recess of the first wall portion, the insulating cover is stripped when it is pressurizingly inserted into the recess of the second wall portion, so that the conductor of the electrical wire is brought into contact with the inner surface of the recess of the second wall portion to establish an electrical connection between the electrical wire and the connecting member. As a result, an electrical connection between the electrical wire and the terminal connector is established.

In the conventional terminal connector as described above, however, there are disadvantages such as follows. Namely, in the conventional terminal connector, since two processes that mounts the connecting member to the terminal body and connects the electrical wire to the connecting member at the two recesses are required in order to connect the electrical wire to the terminal connector, it is difficult to improve operation efficiency for the connection. Further, in the conventional terminal connector, since the size of the electrical wire is changed, it is required to prepare different connecting members having recesses of different sizes. This means trouble in parts control of the terminal connector since each of these connecting members has bulky nature due to its structure.

SUMMARY OF THE INVENTION

In view of the above disadvantages of the conventional terminal connector, a main object of the present invention is to improve operation efficiency at the time when an electrical wire is electrically connected thereto.

Another object of the present invention is to diminish the size of a connecting member for making part control of the connecting members easy.

In order to achieve the main object, a terminal connector to which an electrical wire is to be connected according to the present invention comprises an electrical connecting section to which a partner member is electrically connected, an electrical wire connecting section to which the electrical wire is to be connected, and a connecting member to be mounted to the electrical wire connecting section for electrically connecting an conductor of the electrical wire to the electrical wire connecting section during the mounting operation of the connecting member to the electrical connecting section.

Since the terminal connector according to the present invention comprises the connecting member as stated above, an electrical connection between the electrical wire and the terminal connector can be accomplished at substantially the same time of mounting the connecting member to the electrical wire connecting section of the terminal connector. Therefore, it becomes possible to reduce the number of processes for connecting the electrical wire to the terminal connector in comparison with the conventional terminal connector as described above. As a result, operation efficiency at the connecting operation of the electrical wire and the terminal connector can be also improved.

The connecting member may be formed from a U-shaped plate-like conductive member having a recess in which the electrical wire is connected. Then, the width of the recess is slightly smaller than the diameter of the conductor of the electrical wire for establishing good electrical connection there between. Further, the U-shaped connecting member may includes two leg portions each having a tip portion, and each of the tip portions of the leg portions of the connecting member may have an inclined edge for cutting the insulating cover when the connecting member is mounted to the terminal connector.

According to the structure as described above, the size of the connecting member is smaller than that of the conventional connecting member, so that parts control for the connecting members becomes easy.

These and other objects, features and advantages of the present invention will be more apparent from the following description of preferred embodiments, taken in conjunction with the accompanying drawings.

DETAILED DESCRIPTION OF THE PREFERRED EMBODIMENTS

Now, with reference to the accompanying drawings, preferred embodiments of the present invention will be described.

Figure 1:
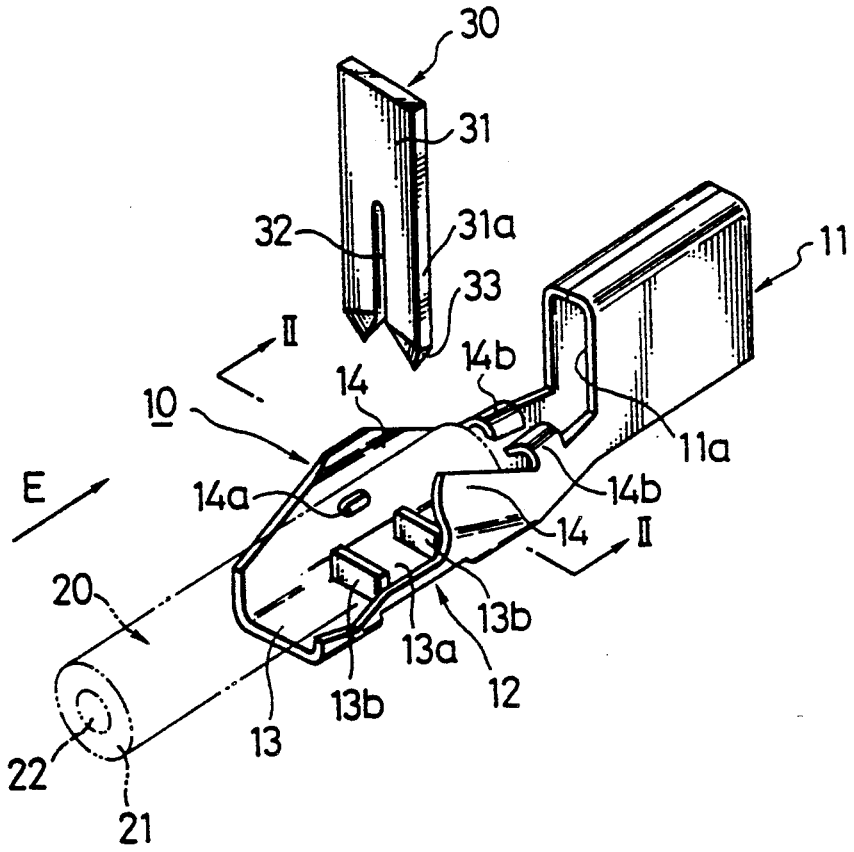
FIG. 1 is a disassembled perspective view of an embodiment of the terminal connector according to the present invention.
Figure 2A:
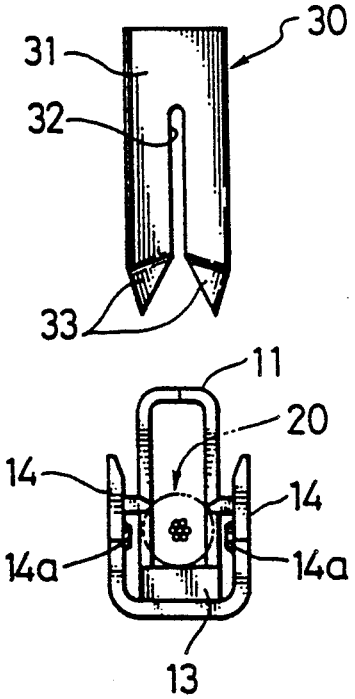
FIG. 2A is a side view of the first embodiment of the present invention, which is seen from the direction "E" in FIG. 1.
Figure 2B:
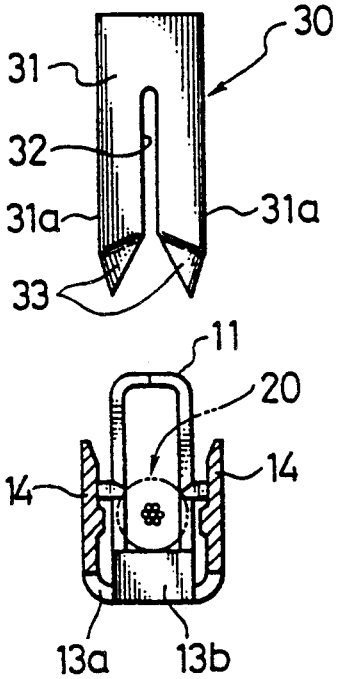
FIG. 2B is a cross sectional view taken along a line II—II in FIG. 1.

FIGS. 1 and 2 show a first embodiment of a terminal connector according to the present invention. The terminal connector of this embodiment comprises a terminal body 10 which has at a front side thereof an electrical connecting section 11 to which a partner terminal (not shown) is electrically connected and at a rear side thereof an electrical wire connecting section 12 to which an electrical wire 20 having a conductor 22 and an insulating cover 21 surrounding the conductor 22 is to be connected.

The electrical connecting section 11 comprises a box-shaped fitted portion 11*a* into which a male tab of the partner terminal is fitted to establish an electrical connection therebetween.

The electrical wire connecting section 12 comprises a base plate portion 13 having an aperture 13*a* at the center thereof and erected side wall portions 14, 14 provided on opposite sides of the base plate portion 13. Therefore, the electrical wire connecting section 12 has a substantially U-shaped configuration. Inside of each side wall portion 14, there is provided a protrusion 14*a*. Further, on each side wall portion 14 at the position near the electrical connecting section 11, there is provided a stopper 14*b* which is formed by bending a part of the side wall portion inwardly. Furthermore, on the opposite sides of the aperture 13*a* in the elongated direction of the terminal body 10, there are provided protruding parts 13*b*, respectively, on which the electrical wire 20 is laid when it is connected to the terminal connector.

The terminal connector further comprises a connecting member 30 for electrically connecting the conductor 22 of the electrical wire 20 to the terminal body 10 as well as securing the electrical wire to the electrical wire connecting section 12. The connecting member 30 is adapted to be mounted and electrically connected to the electrical wire connecting section 12. The connecting member 30 is formed of a U-shaped plate-like conductive member having two leg portions 31*a* and an elongated recess 32 which is formed between the leg portions 31*a*. As shown in FIG. 1, at the tip portion of each leg portion 31*a* of the connecting member 30, there is formed an inclined edge 33 for cutting or stripping the insulating cover 21 of the electrical wire 20. The width of the recess 32 is slightly smaller than the diameter of the conductor 20 in order to achieve good electrical connection therebetween. However, the width of the recess 32 and the thickness of the connecting member should be changed in accordance with a size of an electrical wire to be connected.

Figure 3:
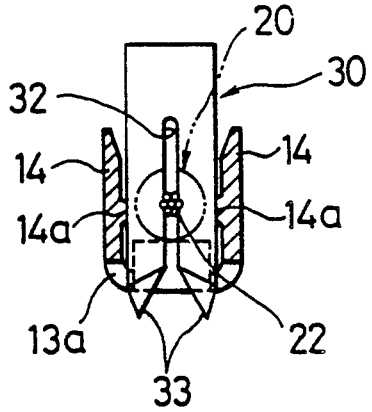
FIG. 3 is a cross sectional view showing the condition that the electrical wire is connected to the terminal connector by the connecting member of the present invention.

When the electrical wire 20 is connected to the terminal connector having the above structure, first the electrical wire 20 is inserted into the U-shaped electrical wire connecting section 20 from the rear side thereof until the tip portion of the electrical wire 20 abuts against the stoppers 14*b*. Thereafter, the connecting member 30 is pressurizingly inserted and mounted to the electrical wire connecting section 12 from the upside of the terminal body 10, namely from the direction perpendicular to the longitudinal direction of the terminal body 10. During this inserting and mounting operation of the connecting member 30, the insulating cover 21 of the electrical wire 20 is cut or stripped by the edges 33 of the connecting member 30. Then, the conductor 22 of the electrical wire 20 is tightly fitted within the recess 32 of the connecting member 30, so that the electrical wire 20 is secured to the connecting member 30. In this condition, as shown in FIG. 3, an electrical connection between the conductor 22 of the electrical wire 20 and the connecting member 30 is also achieved. Further, in this condition, the connecting member 30 is also fitted between the protrusions 14*a* of the side wall portions 14 of the electrical wire connecting section 12, so that the connecting member 30 is secured to the terminal body 10. Then, electrical connection between the terminal body 10 and the connecting member 30 is also achieved. As a result, electrical connection between the electrical wire 20 and the terminal body 10 is also established through the connecting member 30. In this state, as shown in FIG. 3, the edges 33 of the connecting member 30 are protruded outside from the aperture 13*a* of the base plate portion 13.

According to the embodiment as described above, the electrical wire 20 can be secured and electrically connected to the terminal body 10 during the mounting operation of the connecting member 30 to the electrical wire connecting section 12 of the terminal body 10. In other words, the electrical wire 20 can be secured and electrically connected to the terminal body 10 substantially the same time as mounting of the connecting member 30 to the terminal body 10. Therefore, the operation efficiency at the connection of the electrical wire to the terminal body is remarkably improved in comparison with the conventional terminal connector.

Further, since the connecting member has the U-shaped plate-like configuration as described above, it is not so bulky as that of the conventional terminal connector. Therefore, it becomes unnecessary to prepare so wide space for custody thereof, thus leading to improvement in parts control thereof.

Furthermore, under the mounting condition of the connecting member 30 to the electrical wire connecting section 12, the recess 32 of the connecting member 30 is normally being narrowed from the opposite sides by the abutments between the protrusions 14*a* of the side wall portions 14 of the electrical wire connecting section 12 and the leg portions 31*a* of the connecting member 30. Therefore, good electrical connection between the conductor 22 of the electrical wire 20 and the connecting member 30 will be kept, even if stress exerted in the leg portion 31*a* of the connecting member 30 will be deteriorated during long time use thereof.

Figure 4A:
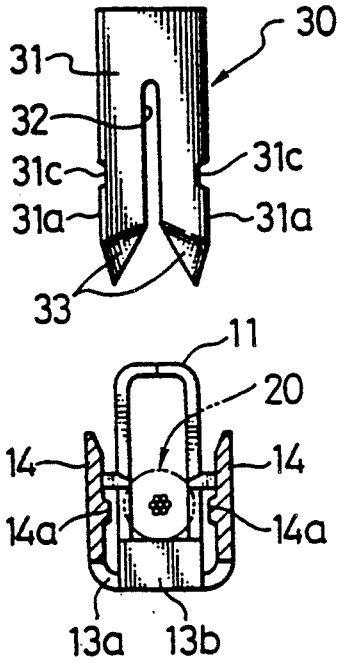
FIG. 4A is a cross sectional view of one modification of the first embodiment.

In the foregoing embodiment, the protrusions 14*a* are provided on the side wall parts 14 of the electrical wire connecting section 12. However, it is possible, as illustrated in FIG. 4A, to form a notch 31*c* on each of leg portion 31*a*, which is engageable with each of the protrusions 14*a* when the connecting member 30 is duly mounted to the electrical wire connecting section 12. If thus formed connecting member is used, more stable mounting condition can be obtained.

Figure 4B:
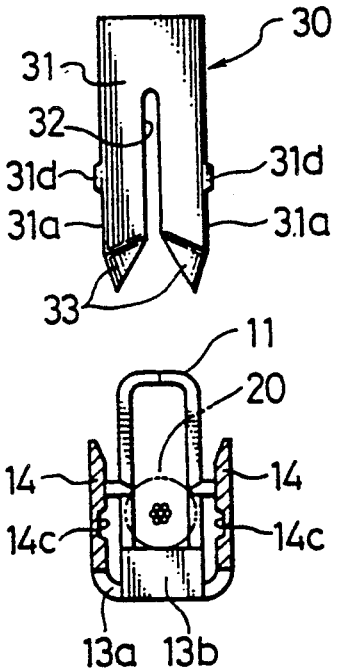
FIG. 4B is a cross sectional view of another modification of the first embodiment.

Furthermore, it is of course possible, as shown in FIG. 4B, to form a protrusion 31*d* on each of the leg portions 31*a* of the connecting member 30 and a notch 14*c*, which is engageable with the protrusion 31*d* when the connecting member 30 is duly mounted to the electrical wire connecting section 12, on each of the side wall portions 14 of the electrical wire connecting section 12.

Figure 5:
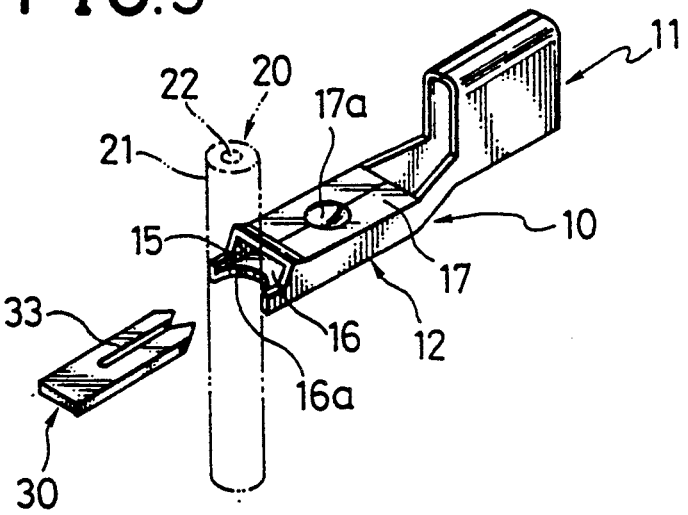
FIG. 5 is a perspective view of a second embodiment of the terminal connector according to the present invention.
Figure 6:
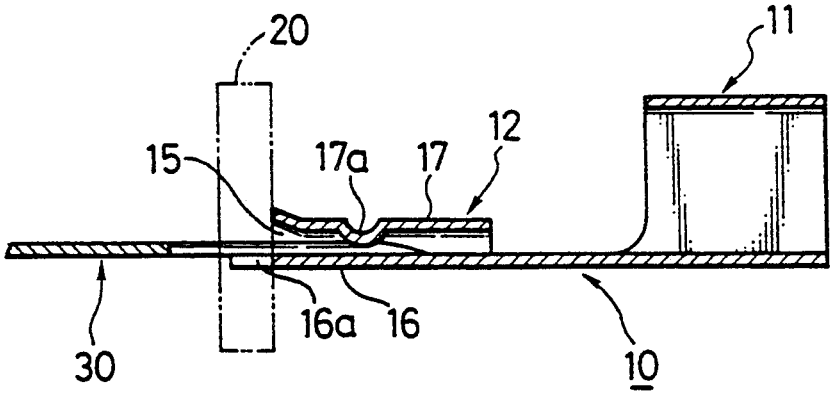
FIG. 6 is a cross sectional view of the second embodiment.

FIGS. 5 and 6 show a second embodiment of a terminal connector of the present invention. In this second embodiment, a terminal body 10 of the terminal connector comprises an electrical connecting section 11 provided on a front side of the terminal body 10 and an electrical wire connecting section 12 provided on a rear side thereof. The electrical wire connecting section 12 is formed as a flattened box shape having an opening 15 from which a connecting member 30 is inserted. At the opening 15 of the electrical wire connecting section 12, there is formed a semi-circular notch 16*a* to a base plate portion 16 of the electrical wire connecting section 12. Further, on the electrical wire connecting section 12, there is formed a concave portion 17*a* which protrudes toward the base plate portion 16 so as to sandwich the connecting member 30 to be inserted into the opening 15 between the concave portion 17*a* and the base plate portion 16.

In use of thus formed connector terminal of this embodiment, first an electrical wire 20 is placed with respect to the terminal connector in such a manner that the wire 20 is fitted in the notch 16*a* of the electrical wire connecting section 12 as illustrated by a dotted line in FIG. 5. In other words, the wire 20 is placed against the terminal body 10 so as to be perpendicular to the elongated direction of the terminal body 10 thereof. Thereafter, the connecting member 30 which has the same structure as that of the first embodiment as described above is pressurizingly inserted into the opening 15 from the rear side of the terminal body 10 so as to cut an insulating cover 21 by edges formed on leg portions of the connecting member 30. Then, in the same manner as the first embodiment, a conductor 22 of the electrical wire 20 is secured within a recess 33 of the connecting member to establish an electrical connection between the connecting member 30 and the conductor 22. Further, thus inserted connecting member 30 is secured to the electrical wire connecting section 12 by the sandwich between the concave portion 17*a* and the base plate portion 16. Under the condition, an electrical connection between the connecting member 30 and the electrical wire connecting section 12 is also achieved, so that an electrical connection between the electrical wire 20 and the terminal body 10 is also established through the connecting member 30. In this condition, the electrical wire is firmly secured to the terminal connector at the notch 16*a* of the electrical wire connecting section 12.

According to the second embodiment of this invention, it is also possible to obtain the same advantages as those of the first embodiment.

It will be apparent from the foregoing description that the terminal connector of the present invention has a number of advantages, some of which have been described above. Also, obvious modifications and variations can be made to the indicator of the present invention without departing from the scope of the invention. Accordingly, the scope of the invention is not limited as necessitated by the accompanying claims.

What is claimed is:

1. A terminal connector to which an electrical wire having a conductor and an insulating cover surrounding the conductor is connected, which comprises:

a terminal body having an electrical connecting section to which a partner member is electrically connected, and an electrical wire connecting section to which the electrical wire is to be connected; and a connecting member, which is separate from the terminal body adapted to be mounted to the wire connecting section of the terminal body for electrically connecting the conductor of the electrical wire to the wire connecting section when the connecting member is mounted to the wire connecting section, wherein the connecting member includes a U-shaped plate-like conductive member having a recess, said recess having a width such that a portion of said recess width is slightly smaller than the diameter of the conductor of the electrical wire whereby the conductor of the electrical wire is secured in the recess to establish a reliable electrical connection between the conductor and the wire connecting section when the connecting member is mounted to the wire connecting section in such a manner that the electrical wire is pressed into the U-shaped recess.

2. A terminal connector as claimed in claim 1, wherein the U-shaped connecting member includes two leg portions each having a tip portion, and each of the tip portions of the leg portions of the connecting member has an inclined edge for cutting or stripping the insulating cover when the connecting member is mounted to the wire connecting section of the terminal body.

3. A terminal connector as claimed in claim 2 wherein the wire connecting section of the terminal body has a substantially U-shaped configuration comprising a base plate portion and erected wall portions formed on opposite sides of the base plate portion, and the connecting member is adapted to be mounted to the wire connecting section from the direction substantially perpendicular to the elongated direction of the terminal body.

4. A terminal connector as claimed in claim 3, wherein the terminal connector further comprises means for fixing the connecting member to the wire connecting section of the terminal body.

5. A terminal connector as claimed in claim 4, wherein the fixing means comprises notches formed in each of the leg portions of the U-shaped connecting member and protrusions formed on each of the erected wall portions of the wire connecting section to be engaged with the notches of the connecting member, respectively, when the connecting member is mounted to the wire connecting section of the terminal body.

6. A terminal connector as claimed in claim 4, wherein the fixing means comprises protrusions of the leg portions of the U-shaped connecting member and notches formed on the wire connecting section so as to be engaged with the protrusions of the connecting member, respectively, when the connecting member is mounted to the wire connecting section of the terminal body.

7. A terminal connector as claimed in claim 2, wherein the wire connecting section of the terminal body has a substantially flattened box shape having a base plate portion and a top plate portion, and the connecting member is adapted to be mounted into the box shaped wire connecting section of the terminal body.

8. A terminal connector as claimed in claim 7, wherein the terminal connector further comprises means for fixing the connecting member to the wire connecting section of the terminal body.

9. A terminal connector as claimed in claim 8, wherein the fixing means comprises a concave portion formed on the top plate portion, and the concave portion protrudes toward the base plate portion so as to hold the connecting member therebetween.

10. A terminal connector as claimed in claim 9, wherein the wire connecting section has an opening, and the electrical wire is secured to the wire connecting section at the opening thereof.

* * * * *

UNITED STATES PATENT AND TRADEMARK OFFICE

CERTIFICATE OF CORRECTION

PATENT NO. : 5,000,698

DATED : March 19, 1991

INVENTOR(S) : Katsutoshi KUZUNO et al

It is certified that error appears in the above-identified patent and that said Letters Patent is hereby corrected as shown below:

Column 6:

Claim 6, line 2, after "protrusions" insert --formed in each--.

Signed and Sealed this

Twenty-ninth Day of September, 1992

*Attest:*

DOUGLAS B. COMER

*Attesting Officer*

*Acting Commissioner of Patents and Trademarks*